US007192509B2

(12) United States Patent
Karl et al.

(10) Patent No.: US 7,192,509 B2
(45) Date of Patent: Mar. 20, 2007

(54) PROCESS FOR PRODUCING A METAL STRUCTURE IN FOAM FORM, A METAL FOAM, AND AN ARRANGEMENT HAVING A CARRIER SUBSTRATE AND A METAL FOAM

(75) Inventors: Andreas Karl, Tegernheim (DE); Andreas Muller-Hipper, Regensburg (DE); Ewald Simmerlein-Erlbacher, Ottobrunn (DE)

(73) Assignee: Infineon Technologies AG (DE)

( * ) Notice: Subject to any disclaimer, the term of this patent is extended or adjusted under 35 U.S.C. 154(b) by 0 days.

(21) Appl. No.: 11/062,318

(22) Filed: Feb. 18, 2005

(65) Prior Publication Data

US 2005/0194259 A1 Sep. 8, 2005

Related U.S. Application Data

(63) Continuation of application No. PCT/DE2003/002560, filed on Jul. 30, 2003.

(30) Foreign Application Priority Data

Aug. 21, 2002 (DE) ..... 102 38 284

(51) Int. Cl.
*C25D 1/08* (2006.01)
*C23C 28/02* (2006.01)
*C22C 2/02* (2006.01)

(52) U.S. Cl. ..... 205/75; 205/161; 205/205; 427/203; 427/244; 156/150

(58) Field of Classification Search ..... None
See application file for complete search history.

(56) References Cited

U.S. PATENT DOCUMENTS 3,325,698 A * 6/1967 Mooneyhan ..... 361/508
3,464,898 A * 9/1969 Norris ..... 205/73
3,549,505 A * 12/1970 Hanusa ..... 428/613
3,694,325 A * 9/1972 Katz et al. ..... 205/75
4,882,232 A 11/1989 Bugnet et al.
5,496,650 A * 3/1996 Sugikawa ..... 428/548
5,597,665 A * 1/1997 Harada et al. ..... 429/235
5,640,669 A * 6/1997 Harada et al. ..... 428/552
5,681,673 A * 10/1997 Hattori et al. ..... 429/235

(Continued)

FOREIGN PATENT DOCUMENTS

DE 35 22 287 A1 1/1987

(Continued)

OTHER PUBLICATIONS

Gobel, Rudolf, et al.; "Wissensspeicher Groβen Einheiten", 4. Auflage Berlin: Volk und Wissen Volkseigener Verlag, 1989, P. 49, ISBN 3-06-021707-6.

*Primary Examiner*—John J. Zimmerman
(74) *Attorney, Agent, or Firm*—Dickstein, Shapiro, LLP.

(57) ABSTRACT

Process for producing a metal structure in foam form, including the steps of providing a nonconductive substrate having a foamed structure, applying conductive particles to the substrate, so that the conductive particles are fixed to the entire surface of the substrate, and in particular to each individual pore of the substrate, and introducing the pre-treated substrate into an electroplating device, in which a homogenous metal layer is formed on the conductive particles.

18 Claims, 3 Drawing Sheets

U.S. PATENT DOCUMENTS

| | | | | | |
|---|---|---|---|---|---|
| 5,851,599 | A | * | 12/1998 | Harada et al. | 427/531 |
| 5,881,353 | A | * | 3/1999 | Kamigata et al. | 419/2 |
| 5,943,543 | A | * | 8/1999 | Uchida et al. | 419/2 |
| 6,051,117 | A | * | 4/2000 | Novak et al. | 204/252 |
| 6,984,446 | B2 | * | 1/2006 | Gundlach et al. | 428/323 |
| 2003/0188973 | A1 | * | 10/2003 | Kuhn et al. | 205/138 |
| 2005/0034995 | A1 | * | 2/2005 | Gundlach et al. | 205/261 |

FOREIGN PATENT DOCUMENTS

| | | | | |
|---|---|---|---|---|
| DE | 696 07 070 | T2 | | 9/2000 |
| DE | 101 45 749 | A1 | | 4/2003 |
| DE | 101 45 750 | A1 | | 4/2003 |
| FR | 2 411 902 | | | 7/1979 |
| FR | 2 679 925 | A1 | | 2/1993 |
| GB | 1 289 690 | A | | 9/1972 |
| GB | 2 013 243 | A | | 8/1979 |
| JP | 59-035696 | | * | 2/1984 |
| JP | 08-225865 | | * | 9/1996 |
| WO | WO 95/18350 | | * | 10/1995 |

* cited by examiner

PROCESS FOR PRODUCING A METAL STRUCTURE IN FOAM FORM, A METAL FOAM, AND AN ARRANGEMENT HAVING A CARRIER SUBSTRATE AND A METAL FOAM

CROSS-REFERENCE TO RELATED APPLICATION

This application is a continuation of International Patent Application Serial No. PCT/DE2003/002560, filed Jul. 30, 2003, which published in German on Mar. 11, 2004 as WO 2004/020696, and is incorporated herein by reference in its entirety.

FIELD OF THE INVENTION

The invention relates to a process for producing a metal structure in foam form, to a metal foam and to an arrangement comprising a carrier substrate and a metal foam.

BACKGROUND OF THE INVENTION

Hitherto, it has only been possible to produce a metal structure in foam form, also known as a metal foam, with considerable technical difficulty and high levels of financial outlay.

One known production process consists in foaming aluminum to approx. 1.5 times its original volume. The metal structure in foam form which is thereby formed is a closed-pore structure, i.e. having a large number of pores per unit volume. This aluminum metal structure in foam form is extraordinarily expensive to produce and even this production operation is questionable in ecological terms.

Another known process consists in evaporation-coating a nonconductive plastic substrate which has a foamed structure, i.e. a structure with pores, with metal. In this case, the plastic substrate has to be in panel form and must not exceed a thickness of 1–2 mm. The evaporation coating takes place from the two opposite main sides of the substrate. Only this small thickness can ensure that the surface of the plastic substrate can be provided with a metal layer even in inner regions. After the evaporation coating, the plastic substrate which has been pretreated in this way is introduced into an electroplating device, so that the thin metal layer on the surface of the foamed substrate is thickened by electroplating. On account of the extremely high production costs, the metal structure in foam form which is produced in this manner is not currently in widespread industrial use on account of its high costs. A particular drawback is that the thickness and shape (panel shape) of the plastic substrate are limited by the production technology.

SUMMARY OF THE INVENTION

An object of the present invention is to provide a process for producing a metal structure in foam form which makes it possible to produce an inexpensive metal foam of any desired form. Furthermore, it is intended to provide a metal foam and an arrangement comprising a carrier substrate and a metal foam which may be of any desired form and are suitable for use in a very wide range of industrial applications.

As in the prior art, an electroplating process is used to produce the metal structure in foam form. This means that before the electroplating step can be carried out, the surface of a nonconductive substrate with a foamed structure, i.e. a structure which includes pores, has to have been provided with a conductive surface.

As will become clear from the process steps described below, the process according to the invention makes it possible to generate a homogenous, conductive surface even in inner regions if the substrate has a considerable thickness or is of any other desired shape. Furthermore, the process according to the invention makes it possible to reliably attain electroplating in inner regions of the substrate with a foamed structure.

The difficulty has hitherto resided in the fact that the ions released from an anode of an electroplating device make no contribution to the metalization, also referred to as thickening by electroplating, in the inner regions of the substrate. This is because the electrolyte is depleted in the inner regions of the substrate in such a manner that it is no longer possible for free ions to accumulate at the metallic surface of the foamed substrate. Therefore, in the case of the processes which are known from the prior art, it has hitherto only been possible to process substrates in panel form with a thickness of up to 3 mm to form a metal structure in foam form.

The process according to the invention for producing a metal structure in foam form is no longer subject to these restrictions and comprises the following steps:

- providing a nonconductive substrate having a foamed structure,
- applying conductive particles to the substrate, so that the conductive particles are fixed to the entire surface of the substrate, and in particular to each individual pore of the substrate, and
- introducing the pretreated substrate into an electroplating device, in which a homogenous metal layer is formed on the conductive particles.

Unlike in the case of evaporation coating of the substrate as a pretreatment step for the formation of the metal layer in the prior art, there is provision for conductive particles to be applied to the substrate in such a manner that they are in mechanical and therefore also electrical contact with one another over the entire surface of the substrate. Consequently, unlike in the prior art, it is possible to generate a homogenous i.e. completely continuous, metal layer. Furthermore, the process is not restricted to the use of electroplating metalization.

The substrate may be a commercially available foam material, e.g. comprising polyurethane. The substrate may be in the form of an endless product, a panel product or may be in any desired shape.

The conductive particles are preferably fixed to the surface of the substrate by a bonding agent which is applied to the entire surface of the substrate prior to the step of applying the conductive particles. The bonding agent used is preferably an adhesive which has a sufficiently low viscosity to penetrate into the pores of the substrate, where it covers the surface of each individual interpore web.

By way of example, the bonding agent can be applied to the substrate by immersing the latter in the bonding agent. To ensure that the pores of the substrate are not completely filled with the bonding agent, which would prevent the conductive particles from accumulating at the surface in the pores of the substrate, the bonding agent which does not adhere to the surface of the substrate is preferably removed again. This can be effected in a simple way by pressing out the initially flexible, nonconductive substrate.

Furthermore, it is advantageous if the bonding agent which does adhere to the surface of the substrate is dried or at least partially dried. In this case too, however, it must be ensured that the adhesive properties of the bonding agent are maintained unimpaired, so that the conductive particles which are subsequently applied can be fixed to the surface of the substrate via the bonding agent.

The conductive particles, which may, for example, be copper, silver or any other desired conductive material, an alloy or a polymer, are applied, for example, by blowing (e.g. by means of a nozzle) or by the substrate which has been provided with the bonding agent being immersed in a container holding conductive particles. If the substrate is a sheet-like substrate, the application of the conductive particles can take place from one main side or from the two opposite main sides simultaneously or in succession. If the substrate is an arbitrarily shaped substrate with a three-dimensional form, it is advantageous for the conductive particles to be applied from various sides, in order to ensure that conductive particles pass into each pore.

Wherever the surface of the substrate has been provided with the bonding agent, the conductive particles are fixed to the bonding agent as they are applied. As soon as a surface region of a pore has been provided with the conductive particles, the conductive particles which continue to be applied (e.g. by blowing) no longer adhere to the surface of the substrate, but rather remain "free" inside the pores. Therefore, after the step of applying the conductive particles, a proportion of the conductive particles is fixed to the bonding agent, while another proportion is accommodated in the pores of the substrate lying freely or able to move freely. The last-named proportions are referred to below as further conductive particles.

Depending on the way in which the homogenous metal layer is formed, it may be advantageous to press out the substrate after the conductive particles have been applied, so that at least a proportion of the further conductive particles is removed from the substrate and another proportion is brought into intimate contact with the bonding agent. The other proportion of the conductive particles is formed by the particles which are already adhering to the substrate and some of the "free" particles. The substrate can be pressed out by rolls which are guided over the substrate or by being knocked or pressed out. This step is intended on the one hand to improve mechanical fixing of a proportion of the conductive particles using the bonding agent, and on the other hand also to ensure that the pores of the substrate are not or are not completely filled with further conductive particles which are not fixed to the bonding agent.

As will become clear from the following description of the processes for producing the homogenous metal layer which are used as alternatives or in combination, in the case of electroplating metalization with a current source, the saturation of the electrolyte in the inner regions of the substrate can be controlled by the proportion of the free, further conductive particles in the pores of the substrate. How many of the conductive particles are to remain free in the pores is ultimately dependent on the metalization process used and also an optimization process.

Therefore, in the case of electroplating metalization with a current source, it is expedient if the conductive particles are applied in such a manner that there is an excess of further conductive particles, which are not bonded to the bonding agent, in the inner region of the substrate, and which can be ionized in the electroplating device. In the case of (exclusively) electroless metalization, on the other hand, the use of the further conductive particles can be dispensed with.

As has already been indicated, electroless (chemical) or current-based processes can be used to generate the homogenous metal layer over the entire surface of the substrate. In this context, the term "entire surface" is to be understood as meaning not only the visible part of the substrate. Since the substrate has a foamed structure, i.e. a multiplicity of pores formed by interpore webs, the "entire surface" is therefore formed also by the surfaces of all the pores. Therefore, the "entire surface" also comprises all the undercuts which are not externally visible.

According to a first variant, the generation can be effected by electroless metalization with a metal deposition on the conductive particles by reduction. Therefore, the substrate is immersed in a chemical bath, resulting in a reductive chemical deposition, e.g. of Cu or Ni. This process allows simple and rapid generation of high layer thicknesses (meaning the layer thickness of the homogenous metal layer). Since the process is known per se from the prior art, it does not require any more detailed description at this point.

According to a second variant, the homogenous metal layer can be produced by electroless metalization using an ion exchange process. In this case, base ions (e.g. Cu ions) are exchanged with precious ions (e.g. Ag). This process allows the metal layer to be produced very quickly, but the layer thicknesses which can be achieved are not particularly high.

As an alternative or in addition to the processes which have just been described, electroplating metalization using a current source can also be carried out.

In this case, the above-described, pretreated substrate can be introduced, together with conductive particles and further conductive particles, i.e. free particles which are not fixed to the bonding agent or the surface of the substrate, into an electroplating device, in which the conductive particles which have been fixed to the surface of the substrate via the bonding agent are to be thickened by electroplating. The electroplating device can be of conventional design and includes at least one anode device which is positioned in an electrolyte. The electrolyte may be acidic or cyanide-based. The substrate provided with the conductive particles is connected as cathode, so that ions which are separated from the anode device initially accumulate at the outer regions of the substrate, and that the conductive particles which have been fixed to the surface via the bonding agent are thickened by electroplating. Since the ions which are released from the anode device are already accumulating on the conductive particles in the outer regions of the substrate, the electrolyte is depleted in the interior of the substrate, so that the ions which have been released from the anode device do not make any contribution to the thickening by electroplating in the inner region of the substrate.

However, it has emerged that the further conductive particles (which are not attached to the bonding agent) in the inner regions of the substrate are partially dissolved in the acidic or cyanide-based electrolyte during the electroplating operation and then immediately afterward accumulate at the conductive particles which are fixed to the bonding agent or substrate. This leads to the desired thickening of the conductive particles fixed to the bonding agent in the inner regions of the substrate by electroplating taking place. The free conductive particles in the pores of the substrate therefore saturate the electrolyte again and immediately thereafter are released again at the conductive particles fixed to the bonding agent, which are connected as cathode. The electrolyte is therefore automatically enriched.

It is particularly advantageous if the electrolyte of the electroplating device is matched to the material of the conductive particles. For example, if the conductive particles consist of copper, a copper electrolyte should also be used, since in this case the free copper particles, in a bath which is based, for example, on sulfuric acid, are converted into copper sulfate and can therefore be deposited as elemental metal in ion form.

In the variant described, the electrodes can be continuously exposed to current. However, electroplating metalization with a current source which is in pulsed mode is also conceivable.

In this process, which can likewise be used as an alternative or in addition to the abovementioned electroless processes, it is possible to dispense with the automatic enrichment of the electrolyte by setting the substrate in relative motion with respect to the electrolyte at predetermined intervals. The relative motion causes the inner regions of the substrate to be changed from regions with a depleted electrolyte to regions with a sufficiently enriched electrolyte. The relative motion can be effected by moving the substrate in the electrolyte or by means of a flow of the electrolyte through the substrate being generated at regular intervals. The relative motion should take place during the electroless phase of the electroplating operation, so that enrichment of the electrolyte in the interior of the substrate can take place.

The thickness of the homogenous metal layer which is formed can be controlled as a function of how long the pretreated substrate remains in the electroplating device.

The process according to the invention makes it possible, in a simple way, to produce any desired metal structure in foam form, irrespective of the configuration of the nonconductive starting substrate. In particular, it is possible to produce metal structures in foam form of any desired thickness. The thickness of the homogenous metal layer which is then formed, and also the rate at which the metal layer is generated, can be controlled as a function of which processes are used to produce the homogenous metal layer. The metal structure in foam form can be produced extremely inexpensively and quickly using the process described.

In a further preferred configuration, a further metal layer is applied to the substrate which has been provided with a homogenous metal layer extending over the entire surface. Applying the further metal layer further improves the mechanical stability of the metal foam. Although the thickness of the metal layer could also, as described above, be produced by means of the electroless or current-based process, it is easier and less expensive to produce a further metal layer by immersing the substrate in a melt comprising the further metal. The further metal preferably consists of aluminum, since this ensures a high mechanical stability, combined, at the same time, with a low weight. However, it is also conceivable to use any other desired metal or an alloy.

An advantage of this further process step consists in the fact that the further metal layer can be produced with a considerable layer thickness at low cost, since the process only lasts for a very short time. It has only become possible to immerse the substrate in a metal melt on account of the fact that a substrate which is not inherently able to withstand heat, since it is made from a nonconductive material (e.g. polyurethane), has been provided with a heat-resistant, homogenous metal layer. Should it be possible to produce a substrate in foam form from a heat-resistant material, it would of course also be possible for the process step described to be used without previously generating a metal layer on the surface of the substrate.

In one configuration of the process, the substrate which has been provided with the bonding agent is applied to a carrier substrate, e.g. made from a metal, an alloy or a nonconductive plastic, and then the step of applying the conductive particles is carried out from the side remote from the carrier substrate. This method step results in an arrangement comprising a carrier substrate and a metal foam, in which the metal foam is securely joined to the carrier substrate by the electroplating.

The substrate is initially fixed to the carrier substrate by means of the bonding agent. During application of the conductive particles, they remain stuck both to the bonding agent on or in the nonconductive substrate with a foamed structure and also on the surface of the carrier substrate. When the arrangement comprising the carrier substrate and the substrate with the foamed structure is subsequently introduced into an electroplating device, a homogenous metal layer is formed both on the carrier substrate and also on and in the nonconductive substrate with a foamed structure. On account of the homogeneity of the metal layer, the carrier substrate and the metal foam which is then formed combine to form a single unit. If necessary, the further metal layer can additionally be generated by immersion in a metal melt.

Arrangements of this type comprising a carrier substrate and a metal foam can be used, for example, in the automotive industry for foam-backing of shaped parts, e.g. bumpers, wings, or the like. An arrangement of this type can withstand extremely high mechanical load yet at the same time have a low weight. As is clear from the above description, production is extremely simple to carry out, and production costs are kept at a low level as a result. Furthermore, arrangements of this type also have a sound-insulating function in the field of automotive engineering parts.

A further application area could be in the construction sector by virtue of the metal foam being arranged between two carrier substrates for insulation and stability purposes. The arrangement can be used as a wall. In manufacturing technology terms, the process can be varied in such a manner that a fixed connection to the two opposite carrier substrates is ensured.

In the case of the metal foam according to the invention having a nonconductive substrate with a foamed structure which includes pores, the surface of the substrate is provided with conductive particles on which a homogenous metal layer is arranged. The substrate is preferably an open-pore design and includes a maximum of 50 ppi (pores per inch). The metal foam may take any desired shape, depending in particular on the shape of the substrate on which it is based. In particular, the substrate may have a thickness of more than 3 mm.

In one preferred configuration, the conductive particles are attached to the substrate via a bonding agent, which may for example be an adhesive.

The conductive particles may be arranged on the substrate or the bonding agent with or without an embedding compound surrounding them. It is preferable to dispense with the embedding compound.

It is also conceivable for the conductive particles to be incorporated in the surface of the substrate. This could be achieved, for example, by the conductive particles having been introduced into the starting material used for the substrate to be produced. After the substrate in foam form has been produced, the conductive particles are then incorporated in the substrate, at least a proportion of them being located at the surface.

In one preferred configuration, the conductive particles are in mechanical and therefore also electrical contact with one another. In this case, the electrical contact is not produced for the first time by the homogenous metal layer applied to the conductive particles.

It is preferable for the conductive particles to be arranged in imbricated form with respect to one another, resulting firstly in an approximately constant thickness of the layer formed by the particles and secondly in the desired electrical contact between the particles being produced. This allows a particularly uniform homogenous metal layer to be produced. The layer formed by the conductive particles preferably has a thickness of less than 5 μm.

In a further preferred configuration, a further metal layer, which may but does not have to consist of a different metal, is arranged on the metal layer.

The arrangement according to the invention comprises a carrier substrate and a metal foam, in which the metal foam is fixedly joined to the carrier substrate via the homogenous metal layer formed during the production of the metal foam. The carrier substrate may consist of any desired material, e.g. a metal, an alloy or a nonconductive material. Furthermore, the carrier substrate may take any desired shape, in particular it may have a planar or arbitrarily curved three-dimensional surface.

BRIEF DESCRIPTION OF THE DRAWINGS

The invention is explained in more detail with reference to the following figures, in which.

DETAILED DESCRIPTION OF PREFERRED EMBODIMENTS OF THE INVENTION

Figure 1:
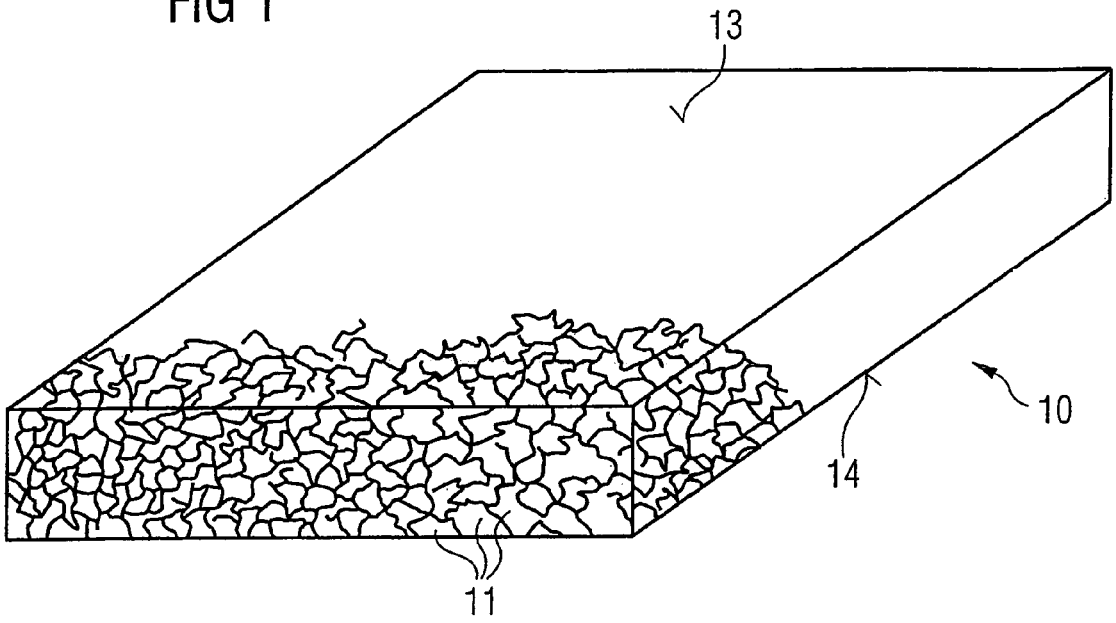
FIG. 1 shows a substrate with a foamed structure which can form the basis of the process according to the invention.

FIG. 1 shows a sheet-like, nonconductive substrate 10 which comprises a foamed structure, i.e. a structure with pores. The substrate consists, for example, of polyurethane, but in principle can consist of any desired nonconductive material. Reference numeral 11 denotes pores that are found in any foamed structure. The size of the pores can be determined by the production of the nonconductive substrates. Substrates with a foamed structure are roughly classified as open-pore or closed-pore foams. As starting material, the invention uses open-pore foams comprising preferably at most 50 ppi. Substrates of this type can be produced in endless form or in panel form.

The process according to the invention can in principle be used irrespective of the size of the pores in the substrate and of the configuration of the substrate. This means that it is not absolutely necessary to use the cuboidal or panel-like form of the substrate 10 with two opposite main sides 13, 14 illustrated in FIG. 1.

Figure 2:
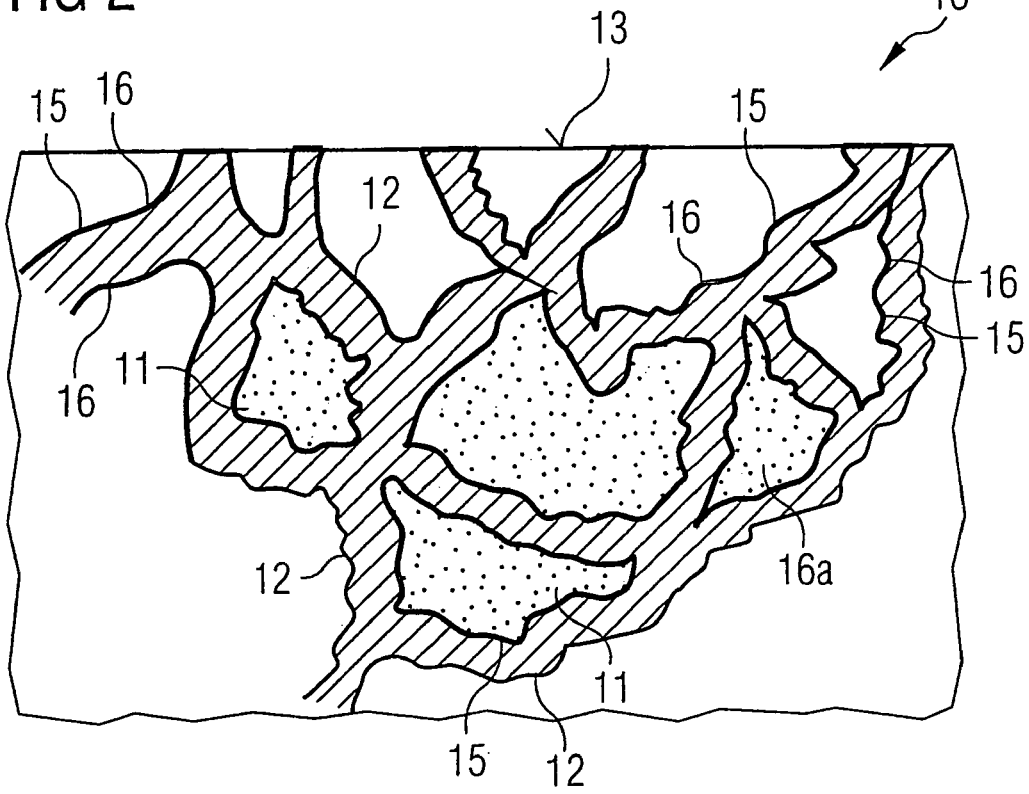
FIGS. 2 and 2*a* show an enlarged excerpt from the substrate illustrated in FIG. 1.

FIG. 2 shows an enlarged excerpt from the substrate 10 shown in FIG. 1. FIG. 2 shows the substrate 10 after the application of a bonding agent 15, which is arranged along the entire surface 12 of each individual pore 11, and after the application of the conductive particles 16 and further conductive particles 16*a*. In this case, reference numeral 16 denotes those conductive particles which are fixed to the bonding agent 15 which may, for example, be an adhesive. Reference symbol 16*a* denotes those conductive particles which are located freely in the interior of the pores 11. The further conductive particles 16*a* are in particular not fixed to the bonding agent 15.

Figure 3:
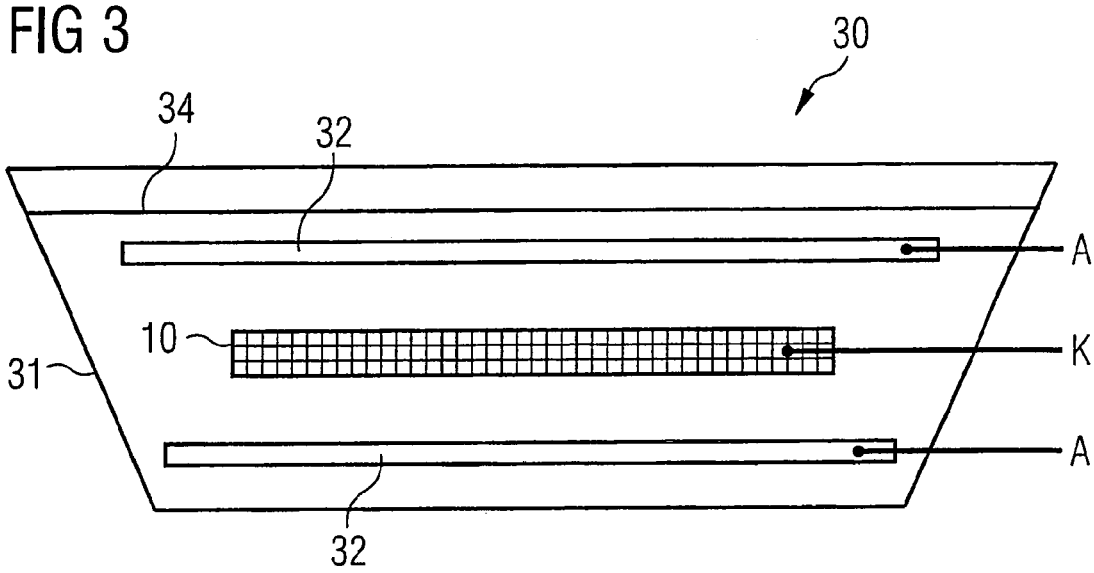
FIG. 3 shows an electroplating device which can be used to carry out the process according to the invention.

This distinction is important in the case of the electroplating metalization with a current source, since the substrate which has been pretreated in accordance with FIG. 2 is connected as cathode after it has been introduced into an electroplating device (FIG. 3). The conductive particles 16 which are fixed to the bonding agent 15 along the surface 12 of the substrate 10 are therefore connected as cathode on account of being arranged substantially close together. The further conductive particles 16*a* located inside the pores 11, by contrast, serve to automatically enrich the electrolyte in the inner regions of the substrate 10.

The term "inner regions" is to be understood as meaning those regions of the substrate 10 which are not located in the region of a main side 13 or any other side of the substrate 10. Accordingly, those pores which adjoin the main side 13 or another main side of the substrate 10 are referred to as "outer regions" of the substrate. The distinction is drawn since the thickening by electroplating in the outer regions of the substrate takes place via the ions released from the anode device 32 and through accumulation on the conductive particles 16. If there were no further conductive particles 16*a* in the inner regions of the substrate 10, the electrolyte would immediately be depleted in the transition region from the outer regions to the inner regions, so that thickening by electroplating would not be possible in the inner regions. The further conductive particles 16*a* serve to compensate for this depletion of the electrolyte 34 and instead to ensure temporary saturation of the electrolyte in the inner regions. The saturation occurs on account of the further conductive particles 16*a* being partially dissolved. Immediately after the electrolyte 34 has been saturated, the ions which are formed are deposited directly at the conductive particles 16 in the inner regions of the substrate 10 and are therefore responsible for the desired thickening by electroplating. As a result, therefore, there is a homogenous metal layer along the surface 12 of the substrate 10. A thicker or thinner homogenous metal layer 17 can be produced, depending on how long the pretreated substrate 10 shown in FIG. 2 is treated in the electroplating device shown in FIG. 3. Further parameters used to control the thickness of the metal layer 17 are the current intensity applied to the anode device 32 and also the choice of electrolyte 34.

The process described can be combined with an electroless metalization with deposition by reduction or with an electroless metalization using an ion exchange process, in which case these processes are carried out prior to the electroplating described. Of course, it is also possible to produce the homogenous metal layer using only the two processes which have just been listed.

While the electroplating process described operates continuously with direct current, it is also possible to produce the homogenous metal layer using a pulsed process. In this case, the depleted electrolyte is replaced with enriched electrolyte by the substrate being set in relative motion with respect to the electrolyte. The relative motion takes place whenever the electrodes are not being exposed to current.

Figure 2A:
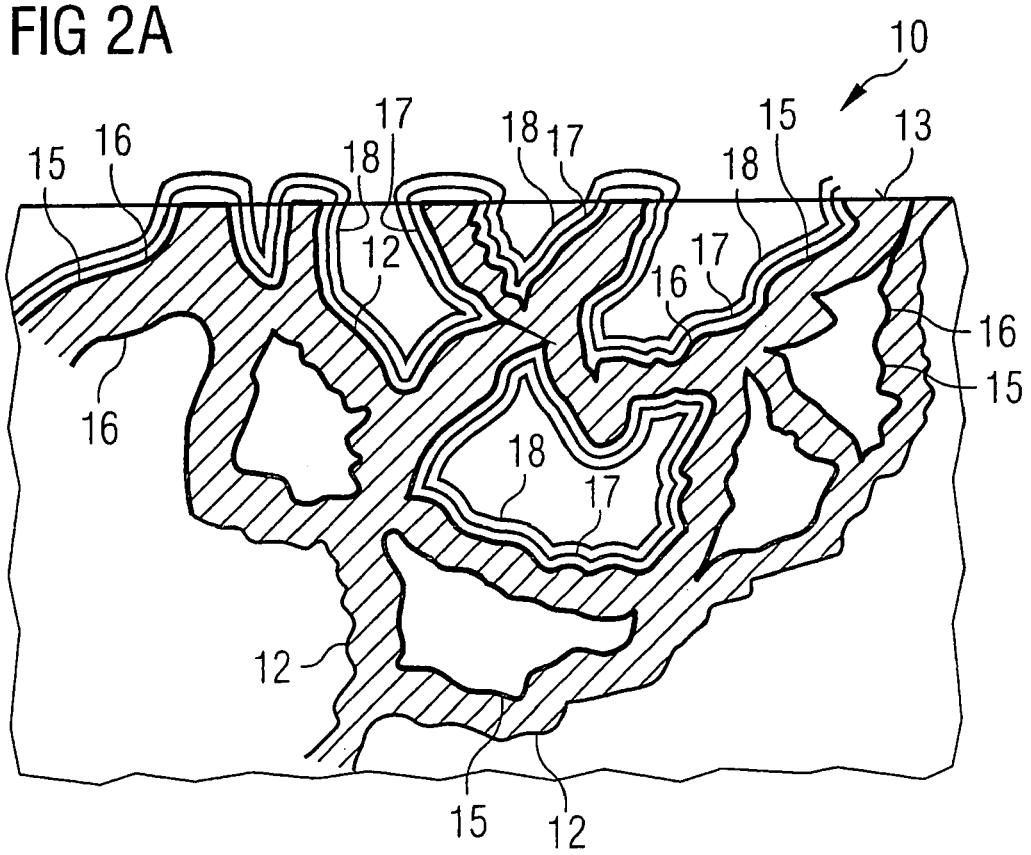

To thicken the metal layer 17, the existing metal foam can be immersed in a metal melt, e.g. comprising aluminum. The metalization of the substrate means that the latter is able to withstand the high temperature of the melt without difficulty. After the immersion operation, a further metal layer 18, which is responsible for further improving the stability of the metal foam, is formed on the metal layer 17. The material on which the further metal layer is based is dependent, inter alia, on how well this material bonds to the material of the metal layer. In FIG. 2*a*, the further metal layer 18 is only indicated for illustration purposes in view of the pores 11.

The diagrammatic electroplating device 30 illustrated in FIG. 3 comprises, in the conventional way, a trough 31 which is filled with an electrolyte 34. In the electrolyte 34 there is an anode device 32, which in the present exemplary embodiment comprises two opposite plates connected as anode, between which the pretreated substrate 10 shown in FIG. 2 is arranged. As has already been described, the pretreated substrate 10 is connected as cathode. It is advantageous if the electrolyte 34 can be made to flow, so that the substrate 10 can be exposed to a flowing electrolyte 34. However, the invention will also work if the electrolyte is static.

Figure 4:
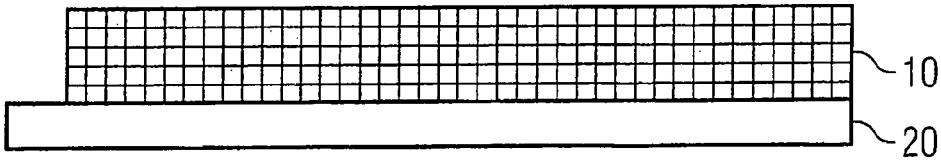
FIG. 4 shows an arrangement comprising a carrier substrate and a metal foam in a first embodiment.
Figure 5:
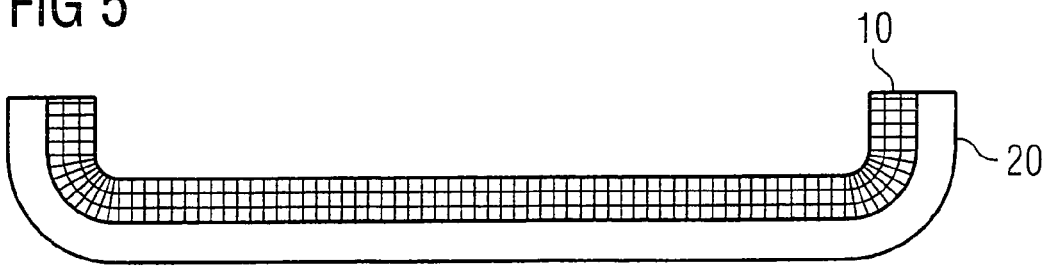
FIG. 5 shows an arrangement comprising a carrier substrate and a metal foam in a second embodiment.

FIGS. 4 and 5 diagrammatically depict two arrangements comprising a carrier substrate and a metal foam, in which the metal foam is fixedly joined to the carrier substrate via the homogenous metal layer by means of the electroplating. The arrangement may in this case be planar (FIG. 4) or three-dimensional (FIG. 5).

The fixed join between the substrate 10 and the carrier substrate 20 is formed by virtue of the substrate 10 first of all having been provided with a bonding agent and then being applied to the carrier substrate 20. The conductive particles, which by way of example may be in powder form, are then applied from the side 20 remote from the carrier substrate. They can be applied, for example, by blowing. The conductive particles therefore stick not only to those surfaces of the substrate 10 which have been provided with the bonding agent but also in the regions of the carrier substrate 20 which have been wetted with the bonding agent.

When the entire arrangement is being introduced into the electroplating device shown in FIG. 3, therefore, a homogenous metal layer which extends along the surface of the carrier substrate 20 toward the surface of the substrate 10 is formed. Arrangements of this type can preferably be used in the automotive industry for the foam-backing of shaped parts (e.g. bumpers or wings). The arrangements produced in this manner are extremely robust, lightweight, inexpensive to produce and, moreover, lead to insulation protection. In particular, it is possible to take account of any desired rounding of a shaped part (of the carrier substrate 20), since in its starting state the foamed substrate 10 is flexible.

What is claimed is:

1. A process for producing a metal structure in foam form, comprising the steps of:

providing a nonconductive substrate having a foamed structure;

applying conductive particles to the substrate, so that the conductive particles are fixed to the entire surface of the substrate, and in particular to each individual pore of the substrate;

introducing the pretreated substrate into an electroplating device, in which a homogenous metal layer is formed on the conductive particles; and applying a further metal layer to the substrate which has been provided with a homogenous metal layer, wherein the further metal layer is applied by immersion in a melt comprising the further metal.

2. The process as claimed in claim 1, wherein the conductive particles are fixed to the surface of the substrate by a bonding agent which is applied to the entire surface of the substrate prior to the step of applying the conductive particles.

3. The process as claimed in claim 2, wherein the bonding agent is applied to the substrate by the substrate being immersed in the bonding agent.

4. The process as claimed in claim 3, wherein the bonding agent which does not adhere to the surface of the substrate is removed.

5. The process as claimed in claim 3, wherein the bonding agent which does adhere to the surface of the substrate is dried.

6. The process as claimed in claim 1, wherein the step of applying the conductive particles comprises the step of pressing out the substrate, so that at least a proportion of the conductive particles are removed from the substrate and another proportion is brought into intimate contact with the bonding agent.

7. A process for producing a metal structure in foam form, comprising the steps of:

providing a nonconductive substrate having a foamed structure;

applying a bonding agent to the entire surface of the substrate;

applying the substrate which has been provided with the bonding agent to a carrier substrate;

applying conductive particles to the substrate from a side remote from the carrier substrate, so that the conductive particles are fixed to the entire surface of the substrate remote from the carrier, and in particular to each individual pore of the substrate, by the bonding agent; and introducing the pretreated substrate into an electroplating device, in which a homogenous metal layer is formed on the conductive particles.

8. The process as claimed in claim 1, wherein the formation of the homogenous metal layer of the foamed substrate is effected by electroless metalization with a metal deposition on the conductive particles by reduction.

9. The process as claimed in claim 1, wherein the homogenous metal layer of the foamed substrate is effected by electroless metalization using an ion exchange process.

10. The process as claimed in claim 1, wherein the formation of the homogenous metal layer in inner regions of the foamed substrate is effected by partially dissolving further conductive particles in an acidic or cyanide-based bath, so that the further conductive particles, which are then in ionized form, accumulate at the conductive particles which have been fixed to the bonding agent.

11. The process as claimed in claim 10, wherein the conductive particles are applied in such a manner that an excess of the further conductive particles is present in the inner regions of the substrate, and the further conductive particles can be ionized in the electroplating device.

12. The process as claimed in claim 11, wherein the further conductive particles which form the excess are not bound in the bonding agent.

13. The process as claimed in claim 1, wherein the formation of the homogenous metal layer in inner regions of the foamed substrate is effected by electroplating metalization using a current source in pulsed mode, in which the pretreated substrate is set in relative motion with respect to an electrolyte at predetermined intervals.

14. The process as claimed in claim 13, wherein the relative movement is effected by moving the substrate in the electrolyte.

15. The process as claimed in claim 13, wherein the relative movement is effected by a flow of the electrolyte through the substrate.

16. The process as claimed in claim 13, wherein the relative movement of the substrate with respect to the electrolyte takes place during the electroless phase of the electroplating operation, so that the electrolyte enrichment can take place inside the substrate.

17. The process as claimed in claim 10, wherein an electrolyte of the electroplating device is matched to the material of the conductive particles.

18. A process for producing a metal structure in foam form, comprising the steps of:

providing a nonconductive substrate having a foamed structure;

applying conductive particles to the substrate, so that the conductive particles are fixed to the entire surface of the substrate, and in particular to each individual pore of the substrate;

introducing the pretreated substrate into an electroplating device, in which a homogenous metal layer is formed on the conductive particles; and applying a further metal layer to the substrate which has been provided with a homogenous metal layer, wherein the further metal is aluminum.

* * * * *